United States Patent [19]

Christini et al.

[11] 4,288,217

[45] Sep. 8, 1981

[54] ROTARY CALCINER FEED SPIRAL

[75] Inventors: James N. Christini; Tai K. Kim, both of Towanda; Robert P. McClintic, Monroeton, all of Pa.

[73] Assignee: GTE Products Corporation, Stamford, Conn.

[21] Appl. No.: 144,126

[22] Filed: Apr. 28, 1980

[51] Int. Cl.[3] ..... F27B 6/08; F27D 3/00

[52] U.S. Cl. ..... 432/112; 34/135; 414/149; 414/197; 432/117; 432/118; 432/239

[58] Field of Search ..... 432/112, 117, 118, 239; 414/149, 197; 34/135, 136, 137

[56] References Cited

U.S. PATENT DOCUMENTS 3,607,121 9/1971 Watson et al. ..... 432/118

4,010,081 3/1977 Martt ..... 414/149

*Primary Examiner*—John J. Camby

*Attorney, Agent, or Firm*—Thomas H. Buffton

[57] ABSTRACT

In a calciner having a rotatable cylindrical retort, an improved material feed spiral has a final turn and a ¾ turn ending immediately adjacent the retort and a next to final turn connected to the final turn and extending outwardly therefrom away from the cylindrical retort. The final turn and ¾ turn are of a height substantially equal to a given percentage of the inner diameter of the retort and the next to final turn tapers from a height substantially equal to the given height of the final turn to a height less than the given height.

12 Claims, 3 Drawing Figures

ROTARY CALCINER FEED SPIRAL

TECHNICAL FIELD

This invention relates to calciners and more particularly to a feed spiral for supplying materials for processing to a rotary calciner.

BACKGROUND ART

Calciners and particularly indirectly-heated rotatable calciners are utilized for heat-treating and drying of materials at temperatures higher than those normally employed in steam-heating apparatus. For example, indirectly-heated calciners having a rotating cylindrical retort are frequently employed to reduce mineral oxides to low oxides, dry and remove sulfur from cobalt, copper and nickel powders, reduce metal oxides, and numerous other similar applications wherein relatively high temperatures are desirable.

In the known types of calciners employing a rotating cylindrical retort, it is a common practice to feed the materal for processing into one end of the retort and collect the processed material from an opposite or discharge end. Also, a series of flights attached to the inner surface of the rotatable retort or a "scraper" chain may be utilized to control the progress of the material as it is processed through the rotating cylindrical retort.

Of the known forms of material feeding apparatus for such rotating calciners, one of the more common is a two-turn spiral structure which uniformly tapers from from a smaller to a larger height as the material progresses to the rotating calciners. Obviously, added turns may be provided prior to the above-mentioned two-turns spiral structure should it be necessary or desirable to increase the distance over which the material is transported.

Although the above-mentioned uniformly tapered material feeding spiral structure has been and still is used with varying degrees of success, it has been found that these are applications wherein such structures do leave something to be desired. For example, it has been found that the rate of material flow and consisting of the feeding of material to the cylindrical retort is less than desired when structures of the above-described configuration are employed. Also, it has been found that the material already in the cylindrical retort had a tendency to feed back into the feeding spiral on structures of the above-described configuration.

DISCLOSURE OF THE INVENTION

In one aspect of the invention a calciner cylindrical retort is provided material by a feed spiral structure having a final turn and a ¾ turn ending adjacent a cylindrical retort and of a height substantially equal to a given percentage of the inner diameter of the cylindrical retort and a next to final turn tapering away from the final turn and decreasing in height from the given height to a height less than the given height.

BEST MODE FOR CARRYING OUT THE INVENTION

For a better understanding of the present invention together with other and further objects, advantages and capabilities of the invention, reference is made to the following disclosure and appended claims in conjunction with the accompanying drawings.

Figure 1:
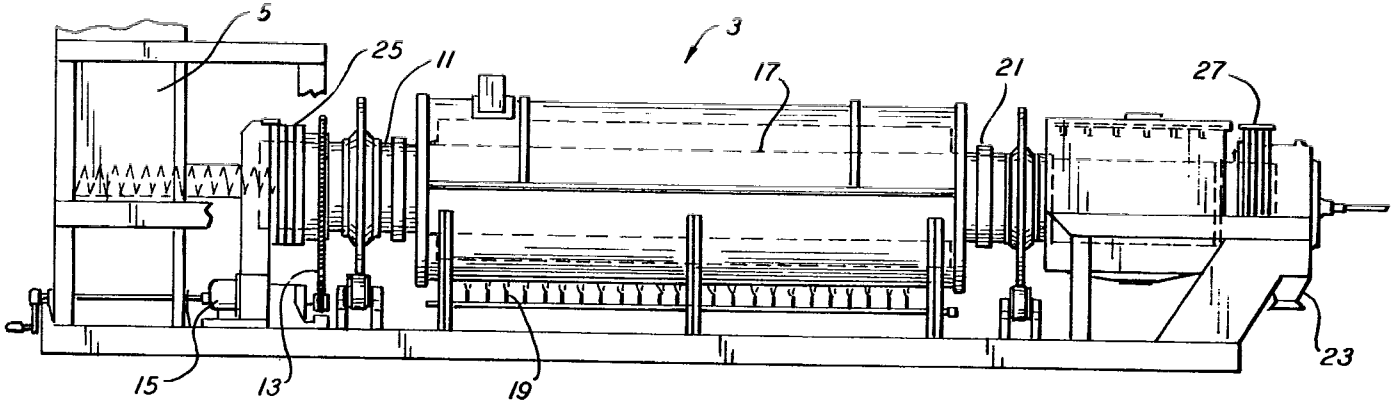
FIG. 1 is a diagrammatic illustration of an indirectly-heated rotatable retort with a material feed structure supplying material to the material receiving end of the rotatable retort.

Referring to FIG. 1 of the drawings, a calciner 3 includes a material receiving bin 5. A screw feed 7 conveys the material from the receiving bin 5 to a material receiving end 9 of a cylindrical retort 11. A chain drive 13 is coupled to the cylindrical retort 11 and to a motor drive 15 which provides energy for rotating the cylindrical retort 11.

Also, the cylindrical retort 11 has a "hot zone" 17 which, in this instance, is indirectly-heated by a plurality of burners 19. This "hot zone" 17 extends to a material discharge end 21 wherefrom the processed material are exited through a discharge chute 23. Moreover, first and second bellows arrangements 25 and 27 are located at the material receiving and discharge ends 19 and 21 respectively whereby atmospheric control of the "hot zone" 17 internal of the cylindrical retort 11 is maintained.

Figure 2:
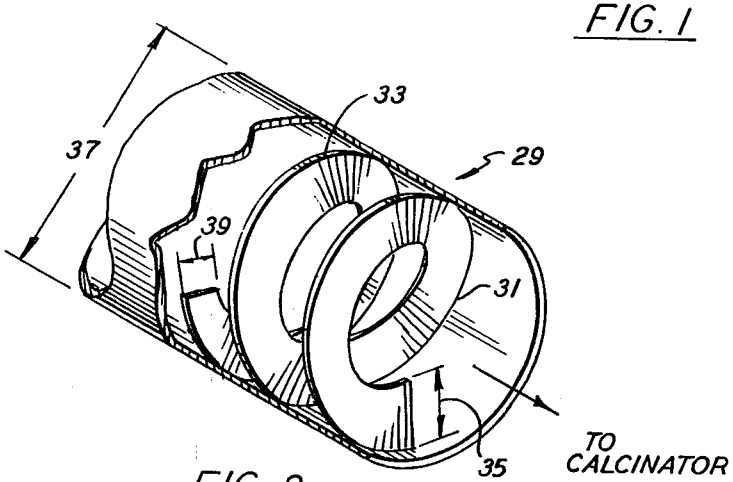
FIG. 2 Prior Art
FIG. 2 is a prior art form of feed spiral normally utilized with a rotatable cylindrical retort.

Referring to the material feed structure and the prior art of FIG. 2, a material feed spiral 29 includes a final turn 31 immediately adjacent a material receiving end 9 of a rotating retort 11 of FIG. 1 and a next to final turn 33 extending outwardly and away from the final turn 31. The final turn 31 of the feed spiral 29 is of a given height 35 which is normally about forty percent (40%) of the inner diameter 37 of the cylindrical retort 11. This final turn 31 and next to final turn 33 taper away from the retort 11 at a substantially uniform rate to a height 39 which is about twenty percent (20%) of the inner diameter 37 of the cylindrical retort 11. Moreover, the feed spiral 29 has a pitch which is about forty percent (40%) of the inner diameter 37 of the cylindrical retort 11.

As previously mentioned, the above-described material feed spiral 29 has been and still is utilized with varying amounts of success. However, it has also been mentioned that there are some applications wherein such structures have been found to be somewhat less than desired in so far as uniformity of feed and flow of material is concerned.

Figure 3:
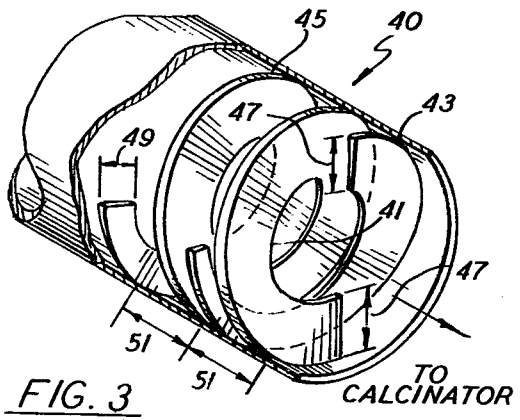
FIG. 3 is a preferred form of feed spiral for a rotatable cylindrical retort.

In this respect, FIG. 3 illustrated a preferred form of feed spiral 40 especially suitable for providing material such as a refractory metal to a calciner having an indirectly-heated rotatable cylindrical retort. Herein, the material feed spiral 40 includes a final turn 41 immediately adjacent the cylindrical retort (not shown); a ¾ turn 43 ending adjacent the cylindrical retort and at a location substantially the same as the final turn 41; and a next to final turn 45 connected to the final turn 43 and extending outwardly and away from the cylindrical retort (not shown).

As to size, an example of a suitable structure would include a cylindrical retort with an inner diameter of about thirty (30) inches. Preferably, the final turn 41 as well as the ¾ turn would then have a height 47 substantially equal to about forty (40%) percent of the inner diameter of the retort or in this example about twelve (12) inches. Also, the next to final turn 45 would taper substantially uniformly outwardly from or away from the final turn 41. Moreover, this next to final turn 45 would preferably have a height of about forty (40%) percent of the final turn 41 at a point connected to the final turn and taper uniformly therefrom to a height 49 of about twenty (20%) of the inner diameter of the cylindrical retort. In this instance, the next to final turn 45 tapers from a height of about twelve (12) inches to one of about six (6) inches. As to pitch 51 of the final turn 41 the ¾ turn 43; and the next to final turn 45, it has been found that a pitch of about forty (40%) percent of the inner diameter of the retort or about twelve (12) inches, in this example, is suitable and desirable.

As to operation, material is supplied to the next to final turn 45 whereby it is transported to the final turn 41 and to the ¾ turn 43. Therefrom, the material for processing is supplied to the rotatable cylindrical retort wherein the desired heat and atmosphere in conjunction with an appropriate processing period combine to provide the desired material processing.

While there has been shown and described what is at present considered the preferred embodiments of the invention, it will be obvious to those skilled in the art that various changes and modifications may be made therein without departing from the invention as defined by the appended claims.

INDUSTRIAL APPLICABILITY

The above-described calciner and material feeding spiral is especially suitable to refractory metal reclaiming techniques wherein a rotatable cylindrical retort is operable at relatively high temperatures and the processing schedule is relatively long. It has been found that the above material feeding spiral tends to restrain the materials within the retort and prevent undesired "feedback" into the feed spiral. As a result, the feed characteristics are enhanced and the flow of processed material significantly improved.

We claim:

1. A material feed spiral for a refractory metal reclaiming calciner having a cylindrical rotatable retort of a given inner diameter with a material receiving end and a material discharging end separated by a hot zone and coupled to a motor drive source, said material feed spiral characterized by the improvement comprising a spiral having a final turn and a ¾-turn rotated 180° therefrom and ending adjacent said material-receiving end of said rotatable retort and a next to final turn connected to and extending outwardly from said final turn and away from said material-receiving end of said rotatable retort, said final turn and said ¾-turn having a height substantially equal to a given percentage of the inner diameter of said cylindrical retort and said next to final turn tapering from said height of a given percentage of said inner diameter of said cylindrical retort to a height less than said given percentage of said inner diameter of said cylindrical retort whereby undesired "feedback" into the material feed spiral is inhibited.

2. The improvement of claim 1 wherein said height of said feed spiral substantially equal to a given percentage of the inner diameter of said cylindrical retort is about forty percent (40%) of said inner diameter of said cylindrical retort.

3. The improvement of claim 1 wherein said height less than said given percentage of the inner diameter of said cylindrical retort is about twenty percent (20%) of said inner diameter of said cylindrical retort.

4. The improvement of claim 1 wherein said final turn and said ¾ turn of said feed spiral have a height of about forty percent (40%) of said inner diameter of said cylindrical retort.

5. The improvement of claim 1 wherein said next to final turn tapers uniformly from a height of about forty percent (40%) to about twenty percent (20%) of said inner diameter of said cylindrical retort.

6. The improvement of claim 1 wherein said material feeding spiral has a pitch of about eighty percent (80%) of said inner diameter of said cylindrical retort.

7. The improvement of claim 1 wherein said inner diameter of said cylindrical retort is about thirty (30) inches, said height of said given percentage is about twelve (12) inches and said height less than said given percentage is about six (6) inches.

8. The improvement of claim 1 wherein said inner diameter of said cylindrical retort is about thirty (30) inches and said pitch of said final and next to final turns is about twelve (12) inches.

9. A material feed spiral for a cylindrical rotatable retort having of a given inner diameter having a material-receiving end and a material-discharging end separated by a hot zone and coupled to a drive motor, said material feed spiral characterized by the improvement comprising a feed spiral having first and second connected turns and a ¾-turn rotated 180° from said second turn, said first turn tapering from a height less than a given percentage to a height of a given percentage of said inner diameter of said cylindrical retort and connected to said second turn and said second turn and said ¾-turn ending immediately adjacent said material-receiving end of said cylindrical retort and having a height substantially equal to said given percentage of said inner diameter of said cylindrical retort.

10. The improvement of claim 9 wherein said given percentage of said inner diameter of said cylindrical retort is about forty (40) percent.

11. The improvement of claim 9 wherein said percentage less than said given percentage of said diameter of said cylindrical retort is about twenty (20) percent.

12. The improvement of claim 9 wherein said next to final turn of said feed spiral tapers uniformly from about twenty (20%) percent to about forty (40) percent of the inner diameter of said cylindrical retort.

* * * * *